US006026801A

United States Patent [19]

Barkan

[11] Patent Number: 6,026,801

[45] Date of Patent: Feb. 22, 2000

[54] PLUG CORE HEAT EXCHANGER

[76] Inventor: Kenneth C. Barkan, 3105 Avalon Rd., Carrollton, Ohio 44615

[21] Appl. No.: 08/837,832

[22] Filed: Apr. 22, 1997

Related U.S. Application Data

[60] Provisional application No. 60/017,079, Apr. 30, 1996.

[51] Int. Cl.[7] ..... F24H 3/00; F22B 5/00

[52] U.S. Cl. ..... 126/99 C; 126/344; 126/362; 126/99 A; 122/406.1; 122/13.1

[58] Field of Search ..... 126/344, 371, 126/362, 99 C, 99 A; 122/406.1, 13.1, 14, 17, 402

[56] References Cited

U.S. PATENT DOCUMENTS 3,396,515 8/1968 Wright ..... 165/366
5,357,907 10/1994 Moore, Jr. et al. ..... 122/406.1

*Primary Examiner*—Larry Jones
*Attorney, Agent, or Firm*—Ralph E. Jocke; Michael C. Pophal

[57] ABSTRACT

An apparatus (10) for transferring heat to a fluid from combustion gases including a housing (12) extending between a first end (14) and a second end (16). The apparatus further includes a burner (24) in which a combustible gas and oxygen react to form hot combustion gases which flow from the burner to a gas outlet (28) in the second end. The fluid flows in a length of helically coiled tubing (30) extending the length of the housing. The tubing includes a fin portion (36) which is spirally wound about the length of tubing. The apparatus further includes a core member (40) which extends within the coils of the tubing, and which engages the tubing. The core member includes a spirally-wound threaded area (62) about which the tubing is wrapped. The core member further includes a recessed portion (66) which creates stagnant air pocket adjacent the end of the core member. In operation the combustion gases leaving the burner are prevented from being short circuited and are directed into the tubing by the core member. The combustion gases are routed by the fin portion along a helical flow path throughout the length of the core member. The combustion gases are transferred into contact with the core member every revolution around the tubing. The recessed portion reduces the heat transfer between the core member and the exiting combustive gases.

21 Claims, 7 Drawing Sheets

PLUG CORE HEAT EXCHANGER

CROSS REFERENCES TO RELATED APPLICATIONS

This Application claims the benefit of U.S. Provisional Application No. 60/017,079 filed on Apr. 30, 1996.

TECHNICAL FIELD

This invention relates to heat exchangers, particularly to heat exchangers which include plug core flow restrictors.

BACKGROUND ART

Heat exchangers with cylindrical shells and helical tubes for heating fluids in the tubes are well known in the prior art. Typically the fluid flowing in the tubes is heated with a co-current flowing combustion gas provided by a burner located within the shell. These heat exchangers are typically high efficiency burners which are adapted for use in domestic applications. The exchangers are used continuously, and minor modifications which result in increased heat transfer efficiencies provide great cost savings.

There are two major ways to increase the efficiency of a heat transfer apparatus of the present type. The first way is to increase the conductive, convective and radiative heat transfer from the combustion gases to the water flowing through the tubes. This can be done by increasing the transfer time for heat transfer between the gases and the helical coils by diverting gas in the shell so that it remains in contact with the coils throughout the length of the shell. This can be accomplished by preventing the short circuiting of the gases leaving the burner. This increased heat transfer can also be accomplished by increasing the contact area between the coils and other heat conductive surfaces within the exchanger. Convective heat transfer can also be increased by increasing the Reynold's numbers of the combustion gases thus decreasing film thicknesses adjacent the heat transfer surfaces within the exchanger.

The combustion gases heat the entire exchanger and not only the coils carrying the water. Thus, the overall efficiency of the exchanger can also be improved by decreasing retransfer of heat to the exiting combustion gases from the heat conductive surfaces interior of the exchanger. This can be done by keeping the gases in contact with the coils throughout their path in the exchanger. The exiting gases can also be isolated from heat conductive surfaces thus decreasing both the convective and radiative heat transfer to the exiting gases.

Combustion gases produced by the burner of the heat exchanger are products of the reaction between air and a combustible gas. The reaction products which comprise the combustion gases are formed via a series of reactions between the reactants and intermediate products. The ultimate composition of the combustion gases relies very much upon the temperature at which these series of reactions takes place. Prior art heat exchangers have produced high concentrations of carbon monoxide and other products of incomplete combustion of the combustible gas and oxygen. These high concentrations of undesirable components result from a lowered reaction temperature caused by the cold fluid entering the heat exchanger adjacent the burner. Cold fluid draws heat from the reacting gases resulting in the incomplete products of combustion.

Thus, there exists a need in the prior art for an apparatus for transferring heat to fluids which optimizes heat transfer to the heated fluid, and preheats the entering fluid to reduce the concentrations of incomplete combustion products in the exiting combustion gases.

DISCLOSURE OF INVENTION

An object of the present invention is to provide an apparatus for transferring heat to a fluid from combustion gases which creates a helical flow path for the combustion gases which maximizes both the flow length and residence time of the combustion gases within the apparatus.

A further object of the present invention is to provide an apparatus for transferring heat to a fluid from combustion gases which increases the Reynold's numbers of the combustion gas flowing in the exchanger thus increasing convective heat transfer from the gases to the fluid.

A further object of the present invention is to provide an apparatus for transferring heat to a fluid from combustion gases which includes a helical core and which increases the conductive heat transfer within the apparatus.

A further object of the present invention is to provide an apparatus for transferring heat to a fluid from combustion gases which eliminates any laminar flow film flowing adjacent heat transfer surfaces within the exchanger thus increasing heat transfer resistance and increasing overall heat transfer to the fluid.

A further object of the present invention is to provide an apparatus for transferring heat to a fluid from combustion gases which eliminates channeling and short circuiting of the gases flowing through the exchanger.

A further object of the present invention is to provide an apparatus for transferring heat to a fluid from combustion gases which includes a structure for decreasing the conductive, radiative and convective heat transfer from heat conductive surfaces in the exchanger to exiting combustion gases.

A further object of the present invention is to provide an apparatus for transferring heat to a fluid from combustion gases which routes the gases throughout the exchanger to maximize turbulent flow adjacent the fluid carrying tubes.

A further object of the present invention is to provide an apparatus for transferring heat to a fluid from combustion gases which preheats the fluid to be heated before it enters the exchanger.

A further object of the present invention is to provide an apparatus for transferring heat to a fluid from combustion gases which maintains the reaction temperature between the combustible gases and oxygen at a temperature to maximize the concentrations of carbon dioxide and water in the exiting combustion gases.

Further objects of the present invention will be made apparent from the following Best Modes for Carrying Out Invention and the appended claims.

The foregoing objects are accomplished in the first embodiment of the invention by an apparatus for transferring heat to a fluid from combustion gases which includes a housing. The housing has a cylindrical interior portion extending along a longitudinal axis between a first and a second end.

The apparatus further includes a burner positioned at the first end in the interior portion. The burner is positioned in fluid communication with a source of air and combustible gas such as natural gas. The burner acts as a receptacle for the reaction between the combustible gas and oxygen. This reaction creates combustion gases which flow through the interior portion and exit the housing at the second end of the interior portion.

The heat transfer apparatus further includes a length of helical tubing extending about the longitudinal axis from the first end to the second end of the interior portion. The helical tubing acts as a conduit for the fluid to flow through the housing. The fluid enters the helical tubing at the first end of the interior portion and exits at the second end after being heated in said helical tubing by said combustion gases. The helical tubing forms a first flow path which is aligned with the longitudinal axis for the combustion gases.

The helical tubing includes a fin portion which extends radially about an exterior wall of the helical tubing. The fin portion extends in a spiral fashion about the length of the helical tubing. The fin portion and the exterior wall of the helical tubing forms a second flow path for the combustion gases.

The heat transfer apparatus further includes a generally cylindrical core member positioned along said longitudinal axis in the interior portion to generally block the first flow path. The core member has a reduced portion positioned at a first end of the core member. The reduced portion includes a front area disposed generally normal to the longitudinal axis. The reduced portion further includes a tapered area that extends away from the first end of the core member at an acute angle relative the longitudinal axis. The reduced portion directs the combustion gases flowing from the first end of the interior portion towards the helical tubing.

The core member further includes a ribbed portion which extends along the circumference of the core member between the tapered area and a second end of the core member. The ribbed portion has both a threaded area and a raised area both of which extend in a helical pattern about the exterior surface of the core member. The threaded area is concave in cross section and the raised area is flat and extending generally parallel with the longitudinal axis. The core member engages the helical tubing adjacent the first flow path and directs combustion gases flowing in the first flow path into the second flow path.

The core member further comprises a recessed portion. The recessed portion is formed from a tapered generally cylindrical cavity within the core member adjacent the second end and centrally aligned along the longitudinal axis. The recessed portion contains a constant volume of stagnant combustion gas while the remaining combustion gas flows past the core member to the exit of the interior portion adjacent the second end. The stagnant combustion gas within the recessed portion acts as a buffer for convective heat flow from the core member to the exiting gas. The stagnant combustion gas also acts as an attenuator of both conductive and radiative heat flow from the core member to the exiting gas.

In operation, combustible gas flows to the burner and is combusted forming heated combustion gases. These gases leave the burner and flow towards the core member. While flowing, the gases radiate heat to the adjacent helical tubing and also flow in contact with the tubing to convectively transfer heat. Upon reaching the reduced portion the combustion gases are forced around the core member and against the helical tubing.

The combustion gases circulate along a path between adjacent fin portions of the helical tubing. Combustion gases traverse the length of the interior portion flowing substantially along this helical path. As the combustion gases reach the helical tubing which extends past the core member, the gases leave this second path to again flow along the first path. These exiting gases are prevented from contacting the end of the core member by the stagnant combustion gas housed within the recessed portion.

The foregoing objects are also accomplished in the second embodiment of the invention by an apparatus for preheating the fluid to be heated. The preheating apparatus includes a housing which has an interior portion. The preheating apparatus also includes helical coils of tubing which are positioned throughout the length of the interior portion. The helical tubing is adapted to carry pressurized liquid fluid from a first end of the housing to a second end of the housing. The exterior surface of the helical tubing includes a fin portion which extends in a helical path about the length of helical tubing. The exterior surface of the helical tubing and the generally radially extending fin portion form a helical flow path.

The preheating apparatus also includes a burner in fluid communication with both a combustible gas and air source. The burner is positioned within the interior portion of the housing adjacent the first end. The combustible gases react with air within the burner and form heated combustion gases which flow from the burner to a gas outlet located in the second end of the housing.

The preheating apparatus includes a preheating core member which is positioned between the coils of the helical tubing in the same manner as the core member of the first embodiment. The preheating core member comprises a generally cylindrical hollow shell. The preheating core member is manufactured from heat-conducted aluminum. The walls of the preheating core member are of a thickness that can readily transmit heat from the surrounding combustion gases to the interior of the preheating core member.

The preheating core member includes a reduced portion at a first end which is facing the oncoming flow of the combustion gases. The reduced portion diverts the combustion gases from a laminar flow path which is generally between the coils of the helical tubing to a turbulent one along the helical flow path about the exterior of the helical tubing. The thickness of the preheating core member wall adjacent the reduced portion is thin to rapidly transmit heat to the interior of the preheating core member.

The preheating core member includes both a fluid inlet and a preheated fluid outlet. Both the fluid inlet and the preheated fluid outlet are positioned on the preheating core member at a second end which is opposed from the first end. The fluid inlet is in fluid communication with a feed conduit which extends through the preheating core member from the second end to a head chamber. The head chamber is bounded by the interior surface of the reduced portion. The feed conduit directs fluid towards the heated interior surface. The interior surface acts as an impingement baffle which disburses the fluid radially after contact. The fluid is then routed through a tortuous path by radially extending baffles which are spaced in a longitudinally disposed arrangement throughout the length of the preheating core member. The heated fluid exits the preheating core member at a preheated fluid outlet located at the second end of the preheating core member. The preheated fluid outlet is fluidly connected to a preheated fluid inlet located at the first end of the housing. The preheated fluid inlet is in fluid communication with the helical tubing.

In operation the fluid to be heated travels from a pressurized source to the preheating core member via a cold fluid inlet. Fluid travels through the feed conduit to the head chamber and is directed against the interior surface of the reduced portion. The fluid is then routed through the length of the preheating core member until it leaves through the preheated fluid outlet. Fluid is heated via conduction and convection by the preheating core member surfaces and is routed to the helical tubing via the preheated fluid inlet. Preheated fluid then flows through the length of the housing in the helical tubing where it is heated to a desired temperature by the combustion gases. The preheated fluid entering the housing allows the combustion gases produced in the burner to react at a temperature which results in complete combustion of the combustible gases. The complete combustion also results in a greater net evolution of heat from the reaction between the combustible gases and the air.

BRIEF DESCRIPTION OF DRAWINGS

A preferred embodiment of the invention, a heat transfer apparatus for transferring heat to a fluid from combustion gases, is described hereunder in detail with reference to the accompanying drawings.

BEST MODES FOR CARRYING OUT INVENTION

Figure 1:
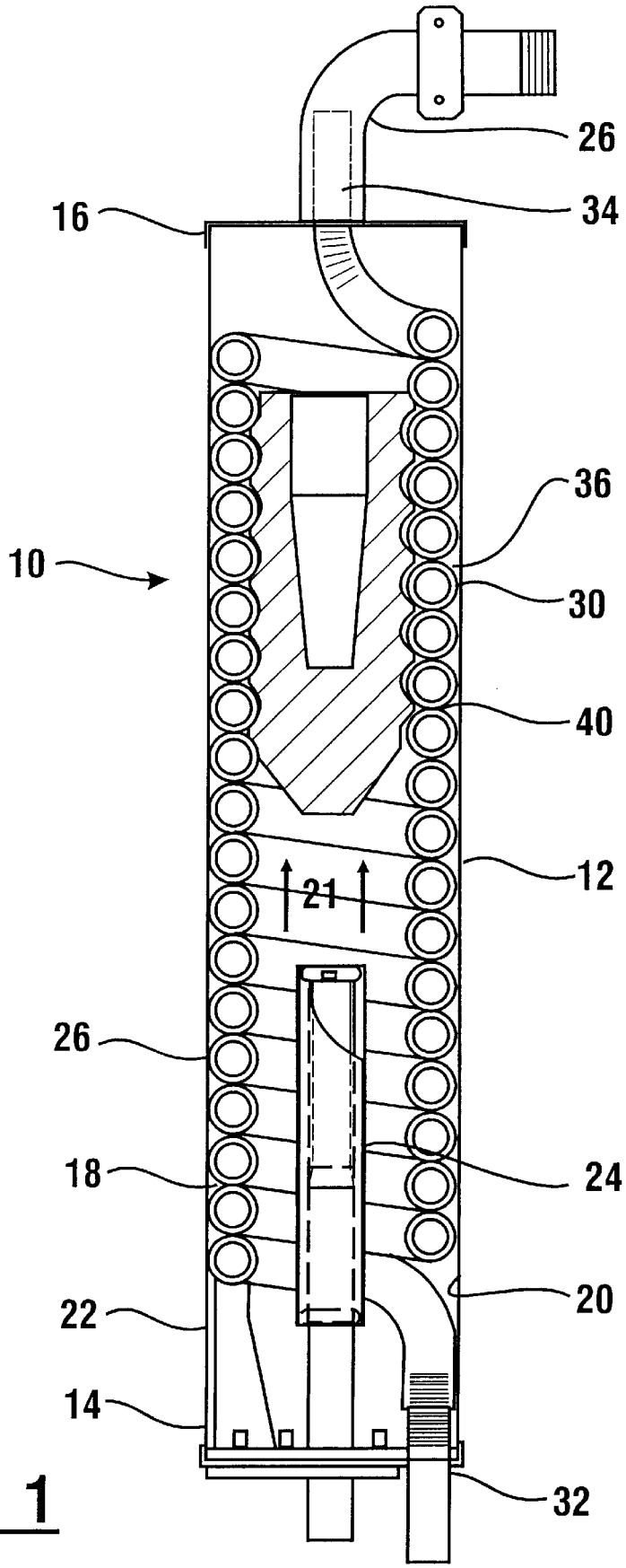
FIG. 1 is a cross-sectional view of the heat transfer apparatus of the present invention.

Referring now to the drawings and particularly to FIG. 1, a first embodiment of the plug core heat exchanger 10 of the present invention is shown. The plug core heater exchanger 10 comprises a cylindrical housing 12 which extends from a first end 14 to a second end 16. Both a combustible gas and a fluid to be heated enter an interior portion 18 of the housing at the first end 14 and co-currently flow through the interior portion until they exit the housing at the second end 16.

The interior portion 18 is bounded by the inner surface 20 of the housing. The housing is manufactured from stainless steel which provides a corrosion resistant and thermal resistant material for long heat exchanger life. An external surface 22 of the housing is insulated to decrease heat transfer from the interior portion through the housing to the external surface.

The combustible gas flows from a combustible gas source through a conduit which transports the gas through the first end 14 to a burner 24. Air is injected to mix with the combustion gas in the conduit and flow with the combustible gas to the burner. The burner 24 is a stainless steel closed end tube extending longitudinally and centrally in the interior portion adjacent the first end 14. The burner also comprises a plurality of holes 26 which are formed through the burner for the passage of the combustion gas-air mixture therethrough. The combustion gas-air mixture is ignited on the surface of the burner so as to provide for a direct open flame heat source. The oxidation of the combustible gas and oxygen produces a high temperature combustion gas. The combustion gas retains the heat of the oxidation reaction and flows from the burner through the interior portion 18 to the second end 16 where it exits via a gas outlet 28. The combustion gases and their passage through the interior portion transmit heat to all other components within the plug flow heat exchanger including the housing. The combustion gases transmit heat via conduction, convection and radiation.

The plug core heat exchanger 10 further includes a helical tubing 30 which extends from the first end 14 at a fluid inlet 32 to the second end 16 and to a fluid outlet 34. The tubing is generally circular in cross section and is disposed in helical coils which are close packed throughout the length of the interior portion. The tubing extends against the inner surface 20 of the housing. The tubing is manufactured from a copper alloy which is highly heat conductive. The tubing forms a first flow path 21 which extends along a longitudinal axis of the housing and through the interior of the tubing coils. In prior art heat exchangers the combustion gases leaving the burner flow along this uninterrupted first flow path to a gas outlet.

Figure 2:
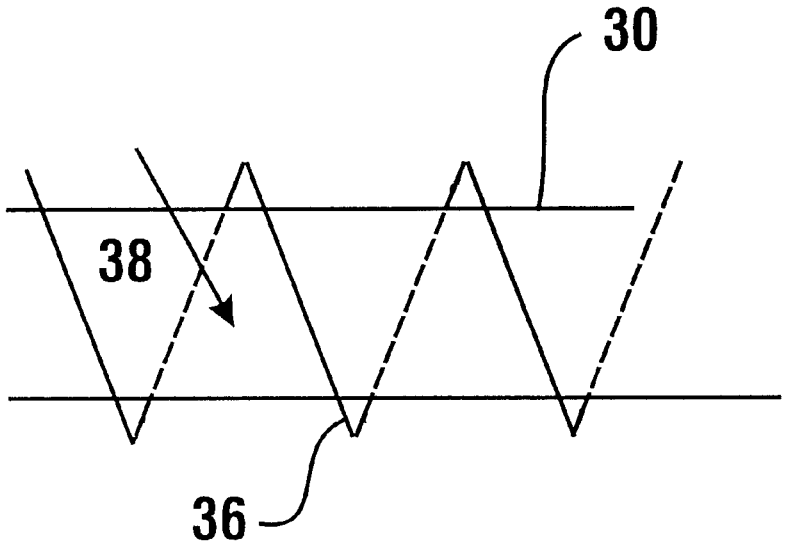
FIG. 2 is a cross-sectional detail view of the tubing and fin portion of the present invention showing the helical flow path.

The tubing 30 further includes a fin portion 36 extending the length of the tubing. The fin portion extends radially from the exterior of the fin portion and is welded or integrally constructed to the exterior surface of the tubing. The fin portion 36 extends helically about the tubing 30. This helical arrangement is best shown in FIG. 2. The pitch of the fins on the tubing is eleven fins per inch. The fin portion is angled at a six degree incline throughout the length of the tubing. The fin portion aids in conduction and convection of heat from the tubing surroundings to the fluid contained within the tubing. The fin portion creates a helical flow path 38 for the combusted gases to pass. This helical flow path 38 equals the longest flow path for the combustion gases flowing through the interior portion. Flow of the combustion gases along the helical flow path results in the maximum heat transfer between the combustion gases and the fluid.

The plug core heat exchanger 10 further includes a core member 40. Core member 40 is generally cylindrical and extends longitudinally through the interior portion and between the tubing coils adjacent the second end 16. The core member substantially blocks the first flow path to generally route the gases to the helical flow path 38 to increase the heat transfer efficiency of the plug core heater exchanger.

In addition to the first flow path and the helical flow path the combustion gases traverse the length of the interior portion via additional paths. The combustion gases leaving the burner initially flow in the first flow path and are affected by the helical coils which induce a rotational flow to the combustion gases. The combustion gases also flow to the outside of the tubes 30 and flow in the interstitial space between the tubes and the inner surface 20. This outside flow path intersects the helical flow path and the gases proceeding along the helical flow path and the outside flow path are mixed. This mixing reduces the effect of any short circuiting of the combustion gases from the burner to the gas outlet.

Figure 3:
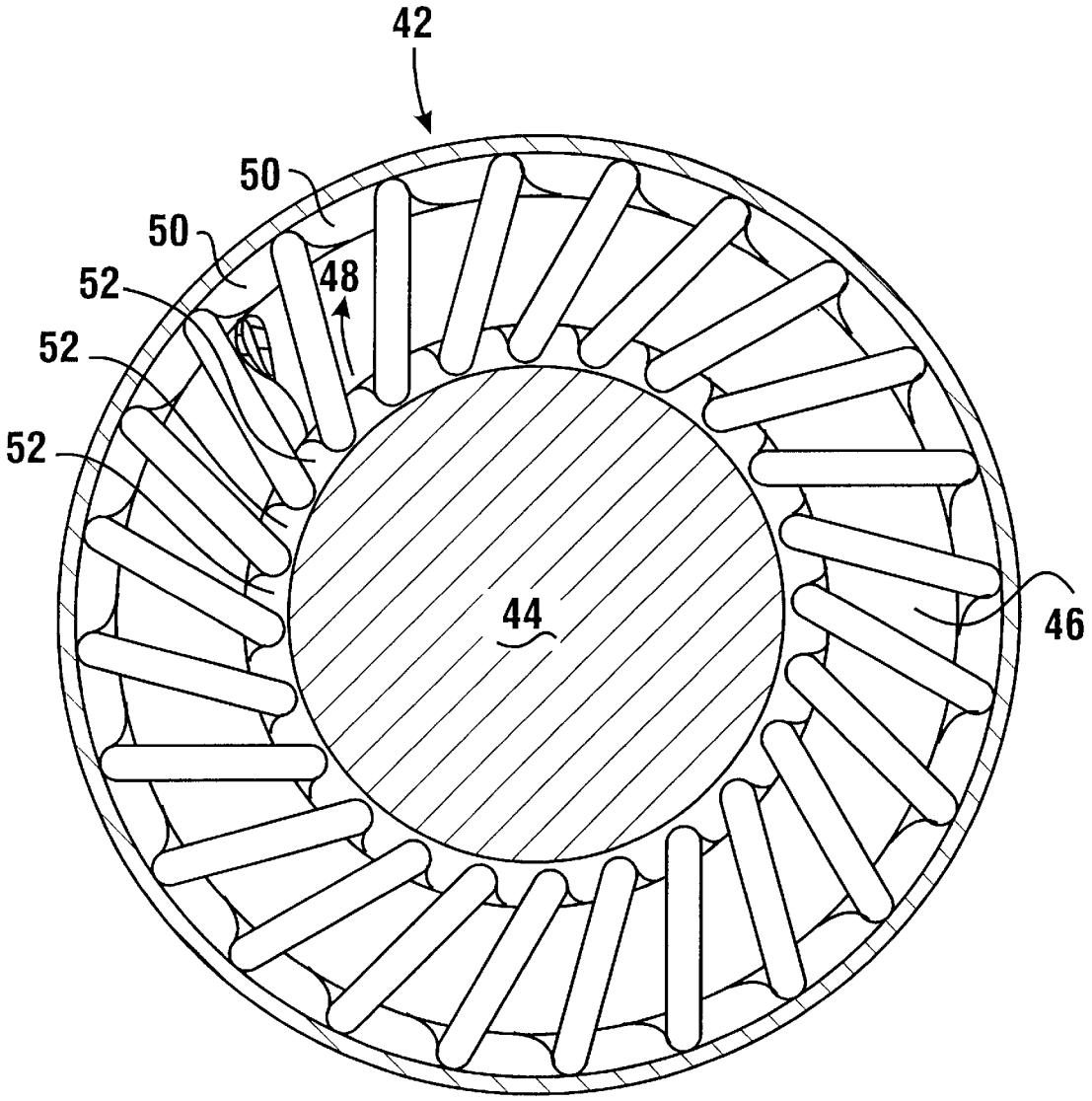
Prior Art FIG. 3
FIG. 3 is a cross-sectional view of a prior art heat exchanger.

FIG. 3 depicts a cross section of a prior art plug core heat exchanger 42. A cylindrical plug core 44 is positioned between a spiral finned tubular coil 46. This prior art exchanger allows combustion gases to follow a helical flow path 48 and an outside flow path 50. The prior art exchanger also allows combustion gases to flow between the plug core 44 and the tubular coil 46 along a short circuiting flow path 52. The short circuiting flow path provides the shortest distance between the burner and the gas outlet for the combustion gases. The short circuiting flow path consists of gases flowing in laminar flow adjacent the plug core 44. This laminar flow barrier acts as an attenuator for heat convection from the plug core to the adjacent gases and helical coiling.

Figure 4:
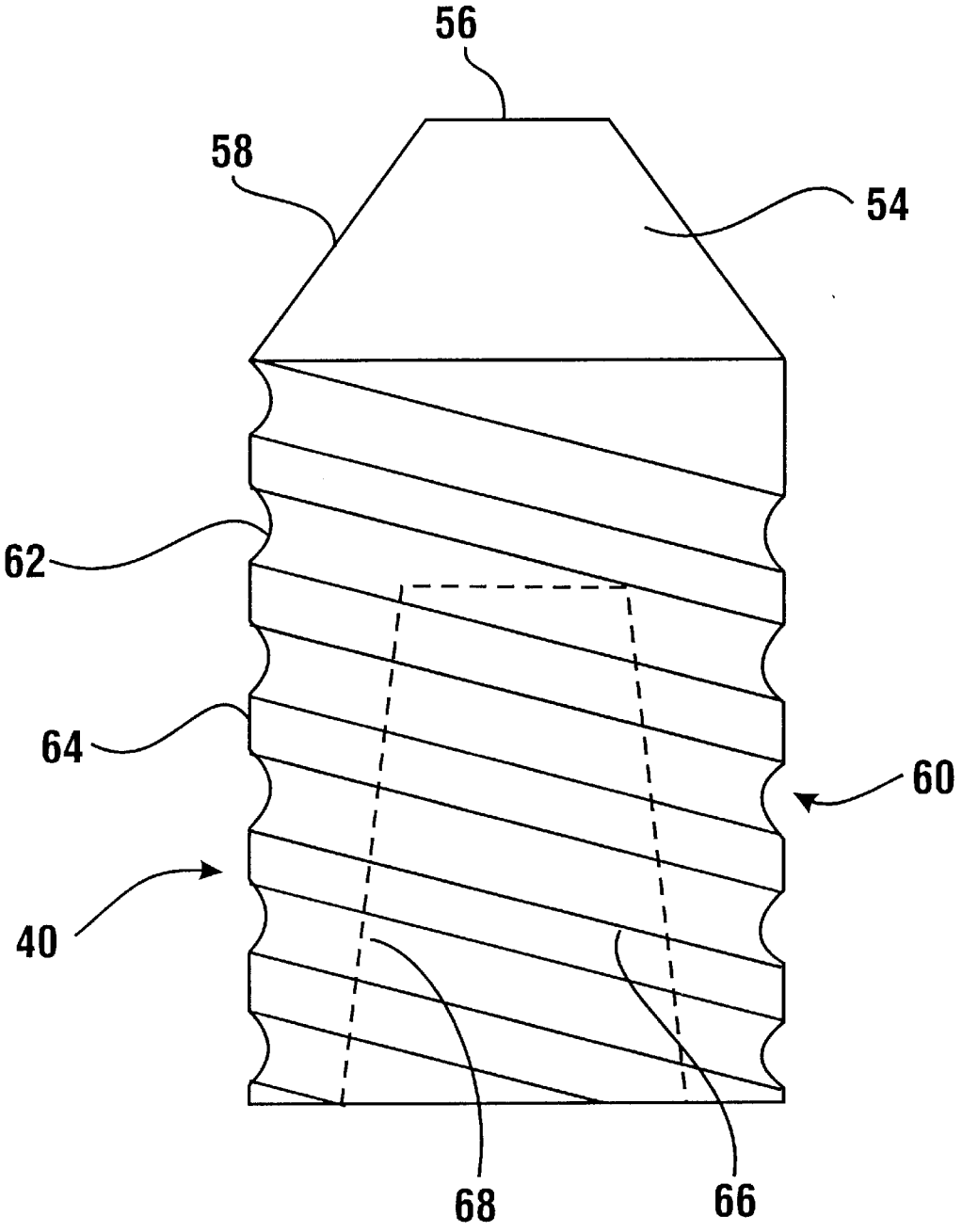
FIG. 4 is a side view of the core member of the present invention.

Core member 40 of the present invention is shown in FIG. 4. Core member 40 comprises a reduced portion 54. Reduced portion 54 is the first area of the core member which meets the combustion gases as they flow from the burner. The reduced portion comprises a front area 56 which extends generally normal to the superficial flow direction of the combustion gases. Reduced portion 54 also comprises a tapered area 58 which extends at an angle directed radially away from the front area. The reduced portion acts to direct the combustion gases out of the first flow path and into the helical flow path 38. Combustion gases meeting the reduced portion are directed radially outward into the helically arrayed tubing.

Core member 40 further includes a ribbed portion 60. The ribbed portion is generally cylindrical and extends longitudinally from the reduced portion. The diameter of the ribbed portion is sized to extend between the adjacent tubing coils. The ribbed portion includes a helically threaded area 62. The threaded area comprises a depressed concave area which extends helically and runs the length of the ribbed portion. The pitch of the adjacent threads in the helically threaded area coincides with the pitch of the coiled tubing 30. The threaded area is adapted to receive the fin portions 36 of the tubing 30. Threaded area 62 alternates with a raised area 64. Raised area 64 extends generally parallel with the inner surface 20 and extends between adjacent tubing coils radially disposed outwards of the fin portion 36.

The ribbed portion 60 further comprises a recessed portion 66. The recessed portion extends into an end of the core member. The recessed portion comprises a machined-out volume of the core member the depth of which extends to generally one-half the length of the core member. In cross section the recessed portion 66 is generally trapezoidal. A surface area 68 of the recessed portion has a central area extending generally parallel with the front area and sides tapered radially outward therefrom. The core member is manufactured from aluminum and provides a good heat transfer medium so as to keep the core member at a generally constant temperature throughout its length.

Figure 5:
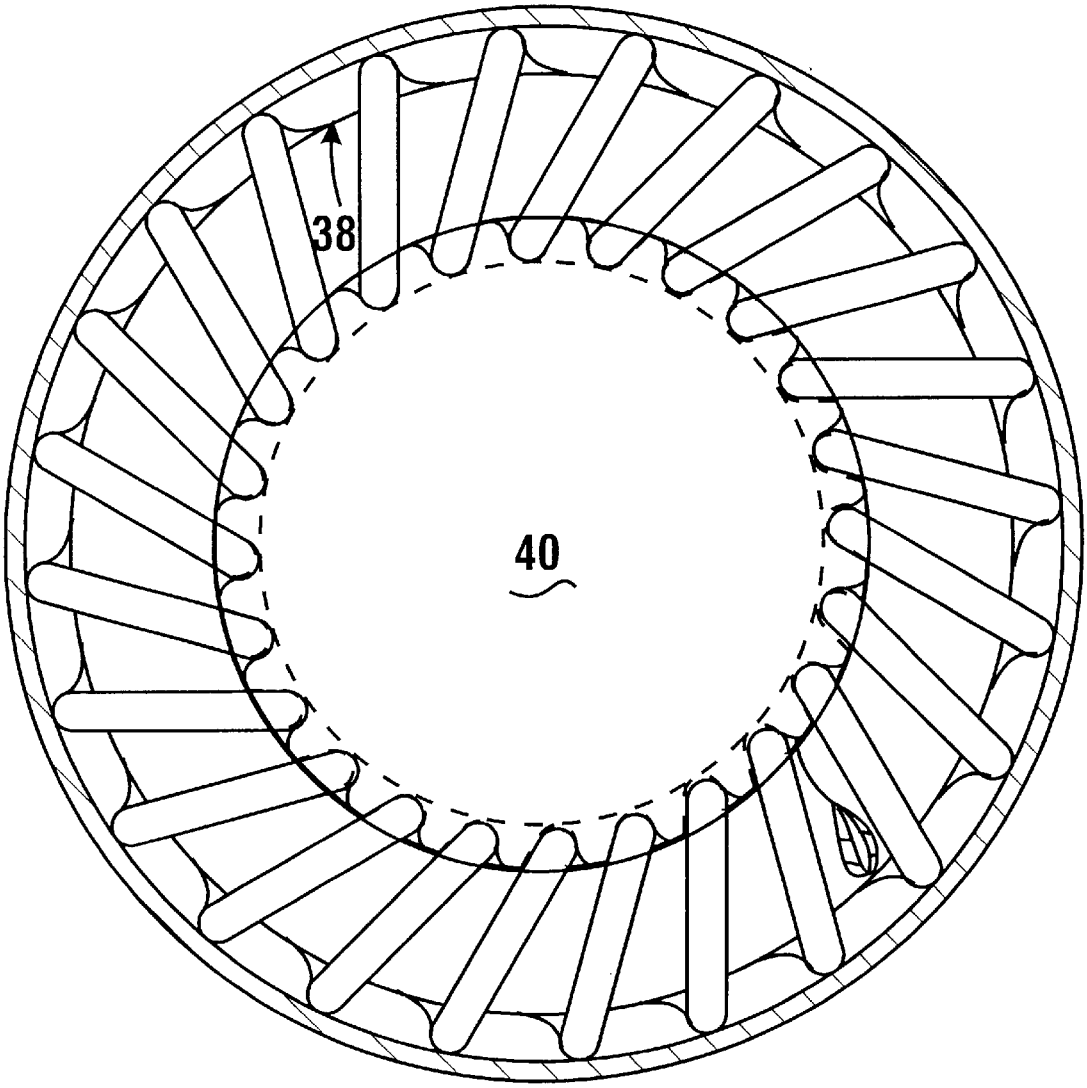
FIG. 5 is a cross-sectional view of the apparatus of the present invention showing the core member and tubing.
Figure 6:
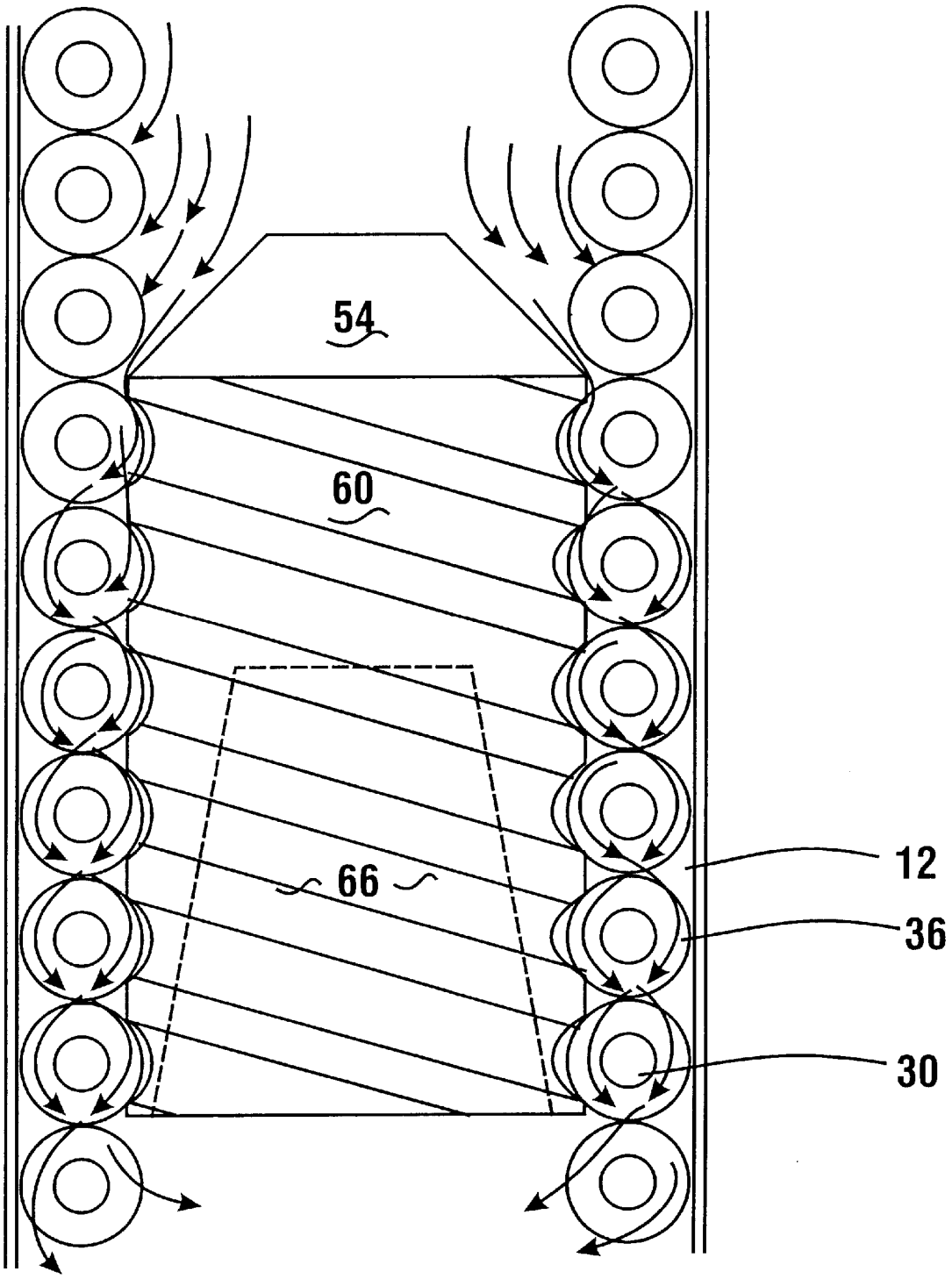
FIG. 6 is a cross-sectional view of the apparatus of the present invention showing the core member, housing and the tubing and the flow paths of the combustion gases therebetween.

Referring now to FIGS. 5 and 6, the disposition of the core member between the tubing 30 is shown. In FIG. 5, it is evident that the core member 40 of the present invention eliminates the short circuiting path of the prior art by extending between adjacent tubes to interrupt the short circuiting path. Gas leaving the burner initially meets the reduced portion 54 and is channeled along the sides of the ribbed portion 60. As the area between the tapered area 58 and the tubes decreases the combustion gas velocity increases until it reaches a maximum when the gas reaches the ribbed portion 60. This compressed gas is forced to flow between adjacent tubes and is routed by the fin portion 36 into the helical flow path 38. As the compressed gas flows along the helical flow path it reaches areas of the helical flow path which are adjacent to the threaded area 62. In these areas the combustion gases pass in turbulent flow into the threaded area resulting in high rates of heat transfer between the core member 40 and the combustion gases.

It should be understood that as the combustion gases proceed along the length of the tubing the combustion gases cool. This cooling is contrasted by the heat accumulation and corresponding temperature rise of the fluid flowing in the tubes. Thus, the heat transfer driving temperature difference potential decreases as the combustion gases near the second end 16 of the housing. Because of the heat conductive nature of the aluminum core member, the core member transmits heat from the heat absorbing reduced portion throughout the length of the rib portion. Thus, the ribbed portion can transmit heat to the cooler combustion gases adjacent the second end. In the prior art the exchangers and the laminar flow of gases present in the short circuiting path prevented effective convective heat transfer from the surface of the core member to the cooler combustion gases. In the present invention the turbulent combustion gases dramatically increase the convective heat transfer from the surface of the core member to the cooler combustion gases relative that which would occur in the prior art laminar flow situations.

The complex shape of the core member also allows for increased contact with the helical tubing. Because of the arrangement of the finned tubing within the threaded area of the rib portion, every revolution of the fin portion 30 engages the surface of the core member as least twice. Thus, the contact surface area between the finned tubing and the core member is increased by at least 100% over the prior art. Because as described above the core member maintains a relatively constant high temperature, the conductive heat transfer from the core member to the fin portion of the tubing plays a major part in the overall heat transfer to the fluid flowing in the tubing adjacent the second end.

Radiative heat transfer also plays a major part in the overall heat transfer between the combustion gases and the circulating fluid. The combustion gases radiate heat to the surrounding metal components of the plug core heat exchanger 10. Similarly, the components of the core member, the tubing, the housing and the burner all radiate heat to each other. Likewise the metal components within the heat exchanger can also radiate heat back to the combustion gases. It is understood that like convective and conductive heat transfer, radiative heat transfer only occurs in the direction of a temperature gradient. Throughout the majority of the length of travel through the interior portion, the combustion gases transmit heat to the components of the plug core heat exchanger. However, the exiting gases adjacent the second end can be much cooler than the surrounding heat exchanger components. Thus, these exiting cooler gases can actually absorb heat from the relatively higher temperature heat exchanger components such as the core member and the housing. The recessed portion 66 creates an air gap 70 between the surface area 68 of the recessed portion and the exiting combustion gases. This air gap 70 comprises a stagnant pocket of gas which decreases conduction of heat from the core member to the exiting gases. This air gap also decreases convective heat loss from the core member by isolating the core member from the exiting gases. The thick gas layer comprising the air gap also results in less radiative heat transfer relative a thinner gas layer.

As described above, the threaded area is adapted to receive the fin portion of the tubing. The pitch of the grooves for the threaded area matches the pitch of the coiled tubing as it is closely packed within the interior portion of the housing. This fit between the core member and the tubing allows the core member to be screwed into the tubing during the manufacture of the plug core heat exchanger. The fit also results in the core member being supported within the interior portion by the tubing. Prior art heat exchangers required a spacer positioned between the core members and the second end of the housing to support the core member within the interior portion. The fit between the core member and the tubing of the present invention eliminates the need for the spacer and reduces the manufacturing time and cost for the plug core heat exchanger.

In the operation of the first embodiment of the invention the combustible gas and air are mixed from their respective sources in a conduit which communicates with the burner 24. The combustible gas reacts with the oxygen in the air on the surface of the burner to form combustion gases which flow from the burner into the interior portion 18. The stainless steel burner radiates heat to the surrounding tubing 30 and to the downstream core member 40. The combustion gases leaving the burner primarily remain within the middle of the helically coiled tubing. Before reaching the core member the combustion gases transmit heat to the surrounding tubing via conduction, convection and radiation.

As the combustion gases approach the reduced portion 54 they are swept radially and into contact with the tubing 30. As the combustion gases pass by the reduced portion, the flow area is reduced increasing the velocity and Reynold's number of the combustion gases as the combustion gases engage the tubing adjacent the core member.

The combustion gases are routed by the fin portion 36 and the tubing 30 into the helical flow path 38. The helical flow path equates to the longest contact time between the surface area of the tubing and the combustion gases. As the combustion gases flow through the helical flow path they engage the surface of the threaded area of the core member each revolution. This contacting facilitates heat transfer between the combustion gases and the surface of the core member.

At the same time as the convective heat transfer between the combustion gases, the core member and the tubing, there is conductive heat transfer between the core member and the tubing 30. As the combustion gases near the second end 16 of the housing 12, the temperature difference between the fluid and the combustion gases decreases as the fluid temperature has increased and the combustion gas temperature has decreased. In this area there is appreciable heat transfer from the core member to the fin portion of the tubing. There also can be heat transfer from the core member to the combustion gases. As the combustion gases pass the surface of the core member they advance towards the gas outlet 28. Heat transfer from the core member to the leaving combustion gases is reduced by the air gap 68 created by the recessed portion 66 of the core member.

Figure 7:
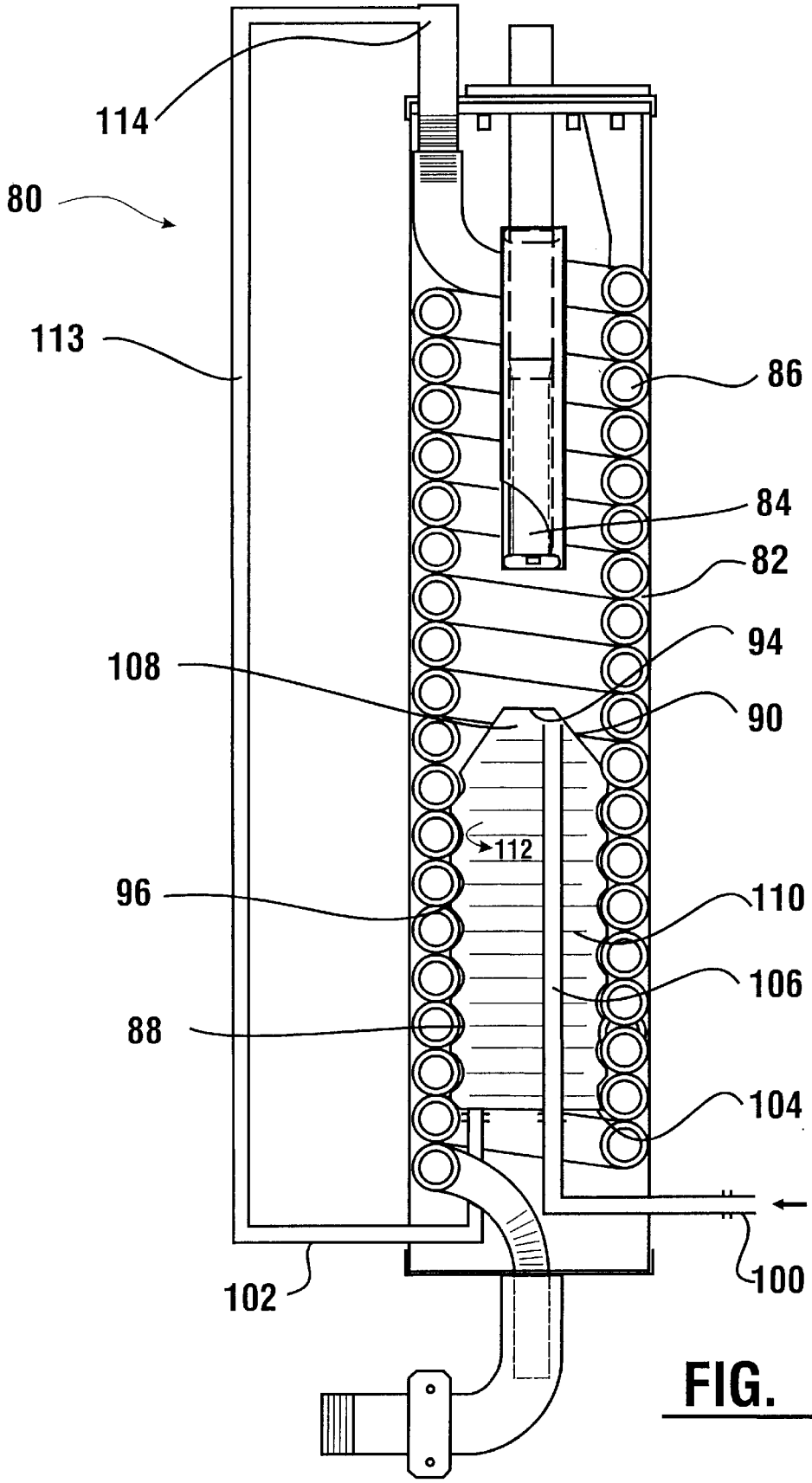
FIG. 7 is a schematic view of the apparatus of the second embodiment of the present invention showing the flow arrangement of the fluid to be heated between the preheating core member, and the helical tubing.

Referring now to FIG. 7 there is shown a second embodiment of the plug core heat exchanger 80. The structure of the second embodiment is similar to the first embodiment shown in FIGS. 1 through 6 in that the heat exchanger 80 includes a cylindrical housing 82, a burner 84, helical tubing 86, and a core member 88. The gas flow paths of the second embodiment of the plug flow heat exchanger 80 is also the same as the gas flow in the first embodiment, as the structure controlling the gas flow is identical. The difference between the first and second embodiments is the way in which the fluid to be heated is routed through the exchanger. In the second embodiment of the plug core heat exchanger 80 the fluid to be heated is initially routed to a preheater before entering the helical tubing. The core member 88 acts as this preheater.

The core member 88 comprises a generally cylindrical hollow shell through which the fluid to be heated flows. The preheating core member is manufactured from heat conductive aluminum. The walls of the core member 88 are of a thickness that can readily transmit heat from the surrounding combustion gases to the fluid to be heated. The exterior of the core member 88 comprises the same structure as that of the first embodiment 10. The core member 88 includes a reduced portion 90 which is positioned at a first end 92 of the core member. As in the first embodiment, the reduced portion 90 diverts the combustion gases from a laminar flow path to a turbulent flow path along the helical fin portions. The thickness of the core member wall adjacent the reduced portion 90 is relatively thin to rapidly transmit heat to an interior surface 94 of the core member.

The external surface of the core member 88 further includes a screw portion 96 which extends along the sides of the core member. As in the first embodiment, the screw portion 96 acts to interrupt any short circuiting of the combustion gases in the plug core heat exchanger 80. Positioned between the helical tubing 86 the screw portion is in constant contact with the combustion gases throughout its length. The external surface 98 of the core member is maintained at a constant high temperature by the combustion gases.

The core member 88 includes both a fluid inlet 100 and a preheated fluid outlet 102. Both the fluid inlet and the preheated fluid outlet are positioned on the core member at a second end 104 of the housing. The fluid inlet 100 is in fluid communication with a feed conduit 106 which extends through the core member from the second end 104 to a head chamber 108. The head chamber is bounded by the interior surface 94 of the reduced portion 90. The feed conduit 106 terminates adjacent the interior surface 94. When the fluid to be heated is flowing through the feed conduit the interior surface acts as an impingement baffle to disburse the fluid radially after it contacts the interior surface.

Core member 88 further includes a plurality of radially extending baffles 110. The baffles are disposed in a spaced longitudinal arrangement throughout the length of the core member. The baffles 110 extend generally normal to the longitudinally extending feed conduit 106. The baffles are arranged to bound a tortuous path 112 from the head chamber 108 to the preheated fluid outlet 102. Each baffle engages a segment of the interior surface 94 and are manufactured from a highly conductive material. Each baffle acts as a fin to conduct heat away from the interior surface for transfer to the fluid to be heated. The tortuous path 112 routes to fluid to be heated into engagement with the interior surface 94 in addition to both surfaces of each baffle.

The preheated fluid outlet 102 is fluidly connected to a preheated fluid inlet 114 located at a first end of the housing 82. The helical tubing 86 is in fluid communication with the preheated fluid inlet 114.

In operation the plug core heat exchanger 80 accepts the fluid to be heated from a pressurized source via the fluid inlet 100. The fluid travels through the fluid inlet to the feed conduit 106. The feed conduit routes the fluid to be heated to the first end of the core member 88 into the head chamber 108. The fluid to be heated is directed against the interior surface 94 of the core member 88 which disperses the fluid radially in a turbulent flow path. The fluid to be heated is then directed along the interior surface along a tortuous path 112 which routes the fluid through the length of the core member through a plurality of baffles 110. The fluid to be heated is kept turbulent by the baffles. The fluid is heated by contracting the inner surface of the core member and the baffles.

The fluid to be heated leaves the core member through the preheated fluid outlet 102. The fluid is preheated via conduction and convection by the core member surfaces which transmit heat from the combustion gases through the walls of the core member.

The preheated fluid is routed to the helical tubing via a preheated liquid conduit 113 to the preheated fluid inlet 114.

The fluid then flows throughout the length of the housing in the helical tubing 86 where it is further heated to a desired temperature by the combustion gases. The elevated temperature of the preheated fluid entering the housing results in a relatively higher gas temperature adjacent the burner 84. This elevated temperature allows the combustion gases produced in the burner to react at a temperature which results in the complete combustion of the combustible gases.

Thus, the invention achieves the above stated objectives, eliminates difficulties encountered in the use of prior devices, solves problems and attains the desired results described herein.

In the foregoing description certain terms have been used for brevity, clarity and understanding. However, no unnecessary limitations can be implied therefrom because these terms are used for descriptive purposes and are intended to be broadly construed. Moreover, the descriptions and illustrations given are by way of examples and the invention is not limited to the exact details shown and described.

Having described the features, discoveries and principles of the invention, the manner in which it is constructed, the advantages and useful results attained, new and usefull structures, devices, elements, arrangements, parts, combinations, systems, equipment, operations and relationships are set forth in the appended claims.

I claim:

1. An apparatus for transferring heat to a fluid from combustion gases comprising:

a housing, wherein said housing includes a cylindrical interior portion extending along a longitudinal axis between a first and a second end;

a burner positioned at said first end in said interior portion, wherein said burner is adapted to create heated combustion gases which can flow through said interior portion and exit the housing at said second end of said interior portion;

tubing extending helically about the longitudinal axis from said first end to said second end of the interior portion, wherein said tubing bounds a first flow path for the combustion gases which is aligned with the longitudinal axis, wherein said tubing is adapted to allow fluid to enter said tubing at the first end of the interior portion, whereby said fluid can exit said interior portion at said second end after being heated in said tubing by said combustion gases, wherein said tubing includes a fin portion which extends radially about an exterior wall of said tubing, wherein said fin portion extends helically about said tubing, wherein said fin portion and said exterior wall of said tubing forms a second flow path for said combustion gases; and a generally cylindrical core member positioned along said longitudinal axis in the interior portion to generally block said first flow path, whereby said combustion gases are directed by said core member into said second flow path, thus increasing heat transfer from said combustion gases.

2. The apparatus according to claim 1, wherein said core member includes a reduced portion positioned at a first end of the core member, said reduced portion includes a front area disposed generally normal to said longitudinal axis, and a tapered area that extends away from said first end of the core member at an acute angle relative the longitudinal axis, whereby said reduced portion directs the combustion gases flowing from the first end of the interior portion towards said tubing, and directs said combustion gases into said second flow path.

3. The apparatus according to claim 2, wherein said core member further includes a ribbed portion which extends along an outer surface of the core member between the tapered area and a second end of the core member, wherein said ribbed portion includes both a threaded area and a raised area both of which extend in a helical pattern about the exterior surface of the core member, wherein said threaded area is concave in cross section and said raised area is generally flat and extending generally parallel with said longitudinal axis.

4. The apparatus according to claim 3, wherein said core member is supported within said interior portion by said tubing, wherein said pitch of said tubing generally equals the pitch of said threaded area, wherein said fin portion engages said ribbed portion adjacent said threaded portion, whereby said fin portion conducts heat from said core member because of said engagement.

5. The apparatus according to claim 3, wherein said core member further includes a recessed portion, wherein said recessed portion bounds a cavity within said core member adjacent said second end and is centrally aligned along said longitudinal axis, whereby said cavity contains a constant volume of stagnant combustion gases.

6. The apparatus according to claim 4, wherein said core member further includes a recessed portion, wherein said recessed portion bounds a cavity within said core member adjacent said second end and is centrally aligned along said longitudinal axis, whereby said cavity contains a constant volume of stagnant combustion gases.

7. The apparatus according to claim 6, wherein said core member is composed of aluminum.

8. The apparatus according to claim 4, wherein said core member comprises a generally cylindrical hollow shell, wherein said core member further comprises both a fluid inlet and a preheated fluid outlet, wherein said preheated fluid outlet is fluidly connected to a preheated fluid inlet located at the first end of the housing, wherein said preheated fluid inlet is in fluid communication with said tubing.

9. The apparatus according to claim 1, wherein said core member further includes a ribbed portion which extends along an outer surface of the core member between the tapered area and a second end of the core member, wherein said ribbed portion includes both a threaded area and a raised area both of which extend in a helical pattern about the exterior surface of the core member, wherein said threaded area is concave in cross section and said raised area is flat and extending generally parallel with said longitudinal axis.

10. The apparatus according to claim 9, wherein said core member is supported within said interior portion by said tubing, wherein said pitch of said tubing generally equals the pitch of said threaded area, wherein said fin portion engages said ribbed portion adjacent said threaded portion, whereby said fin portion conducts heat from said core member because of said engagement.

11. The apparatus according to claim 10, wherein said fin portion engages said threaded area at least twice with each revolution of said fin portion about said tubing.

12. The apparatus according to claim 9, wherein said threaded area bounds said second flow path, whereby convective heat transfer is increased to said fluid flowing within said tubing.

13. The apparatus according to claim 1, wherein said core member further includes a threaded area which extends in a helical pattern about the exterior surface of said core member, wherein said tubing is positioned along said threaded area by the engagement of said fin portion within said threaded area, whereby said core member can be screwed between said tubing during assembly of said apparatus.

14. The apparatus according to claim 1, wherein said core member is supported within said interior portion by said tubing.

15. The apparatus according to claim 1, wherein said core member further includes a raised area which extends in a helical pattern about the exterior surface of said core member, wherein said raised portion is positioned between adjacent revolutions of tubing, whereby said raised area blocks said first flow path, and directs said combustion gases from said first flow path into said second flow path.

16. The apparatus according to claim 1, wherein said core member further includes a recessed portion, wherein said recessed portion bounds a cavity within said core member adjacent said second end and is centrally aligned along said longitudinal axis, whereby said cavity contains a constant volume of stagnant combustion gases.

17. The apparatus according to claim 16, wherein the length of said recessed portion extends at least one half the length of said core member.

18. The apparatus according to claim 16, wherein the diameter of said recessed portion extends at least one half the diameter of said core member.

19. The apparatus according to claim 1, wherein said core member comprises a generally cylindrical hollow shell, wherein said core member further comprises both a fluid inlet and a preheated fluid outlet, wherein said core member is adapted to receive fluid for preheating, wherein the preheated fluid outlet is in fluid connection with the tubing.

20. The apparatus according to claim 19, wherein said preheated fluid outlet is fluidly connected to a preheated fluid inlet located at the first end of the housing, wherein said preheated fluid inlet is in fluid communication with said tubing.

21. An apparatus for transferring heat from combustion gases to a fluid comprising:

a housing, wherein the housing includes a generally cylindrical interior portion extending along a longitudinal axis between a first end and a second end;

a burner positioned adjacent to the first end in the interior portion, wherein the burner generates heated combustion gases, wherein the combustion gases flow through the interior portion and exit the interior portion adjacent to the second end;

tubing extending generally annularly about the longitudinal axis in the interior portion, wherein the tubing bounds a first flow path for the combustion gases, and wherein the first flow path is generally aligned with the longitudinal axis, wherein fluid flows in the tubing and wherein the tubing extends in the interior portion from adjacent the first end to adjacent the second end, whereby fluid in the tubing is heated from the combustion gases, wherein the tubing includes an exterior wall and a fin portion which extends radially about the exterior wall, wherein the fin portion extends generally annularly about the tubing, wherein the fin portion and the exterior wall of the tubing define a second flow path for the combustion gases;

a generally cylindrical core member extending in the interior portion, wherein the core member generally blocks the first flow path, wherein the combustion gases are directed into the second flow path, whereby heat transfer from the combustion gases to the fluid in the tubing is facilitated.

* * * * *